US006793361B2

(12) United States Patent
Matsui

(10) Patent No.: US 6,793,361 B2
(45) Date of Patent: Sep. 21, 2004

(54) BACKLIGHT ILLUMINATOR

(76) Inventor: Hirokazu Matsui, 2-35, 2-chome, Chuo, Otsu-shi, Shiga-ken (JP)

( * ) Notice: Subject to any disclaimer, the term of this patent is extended or adjusted under 35 U.S.C. 154(b) by 0 days.

(21) Appl. No.: 10/170,636

(22) Filed: Jun. 14, 2002

(65) Prior Publication Data

US 2003/0058635 A1 Mar. 27, 2003

(30) Foreign Application Priority Data

Jun. 15, 2001 (JP) ..... 2001-182295

(51) Int. Cl.[7] ..... G09F 13/04

(52) U.S. Cl. ..... 362/97; 362/241; 362/243; 362/247

(58) Field of Search ..... 362/97, 240, 241, 362/243, 247; 349/70

(56) References Cited

U.S. PATENT DOCUMENTS 5,134,553 A * 7/1992 Hasegawa ..... 362/241
6,491,411 B2 * 12/2002 Itoh ..... 362/241

* cited by examiner

*Primary Examiner*—Stephen F. Husar
(74) *Attorney, Agent, or Firm*—Reed Smith LLP; Stanley P. Fisher, Esq.; Juan Carlos A. Marquez, Esq.

(57) ABSTRACT

A reflector for each of linear light sources arranged in parallel at predetermined intervals. The reflector is arranged symmetrically about each linear light source and consisting of three reflective surfaces to reflect light back to three regions of the surface to be illuminated. The first reflective surface is flat horizontal and closest to the light source to reflect light back to a relatively wide range. The second reflective surface is slanted to the horizontal reflective surface to reflect light overlapped with the reflected light by the first reflective surface. The third reflective surface is farthest from the light source and slanted to the horizontal reflective surface so as to reflect light overlapped with the reflected light by the first reflective surface.

5 Claims, 5 Drawing Sheets

BACKLIGHT ILLUMINATOR

BACKGROUND OF THE INVENTION

The present invention relates to a backlight illuminator including a plurality of linear light sources arranged in parallel. More particularly, the present invention relates to a backlight illuminator which is used to illuminate, for example, a liquid crystal display device, and an illumination display board from the rear surface or back side.

Applicant has proposed a backlight illuminator in the co-pending Japanese Patent Application No. 2000-113423.

The backlight illuminator proposed in the co-pending application includes a plurality of linear light sources and a series of reflectors. The plural linear light sources are arranged in parallel at predetermined intervals facing an illumination surface of the backlight illuminator. With this arrangement, each linear light source illuminates each of allocated illumination areas, thereby illuminating the entire illumination surface of the backlight illuminator. The reflector is in the shape of symmetrical continuous wave, and disposed behind the linear light sources along the direction of arrangement of the light sources in order to reflect light back to the illumination surface of the backlight illuminator.

The reflector is made of a high reflective thin sheet material. More specifically, the sheet material is shaped, by means of bending or curving or otherwise, to have the reflective surfaces which includes seven or eight reflective surfaces. Each of the reflective surfaces reflects light back to the surface to be illuminated on which the reflected light is partially overlapped so as to achieve illumination which ensures the highest possible uniformity of brightness all over the surface to be illuminated.

This illuminator ensures a high brightness and high uniformity of brightness for the surface to be illuminated. However, the reflector used in the illuminator is liable to break during the bending or curving process of the reflector, if the reflector is fabricated by using a white foamed resin, such as, for example, a polyester foamed sheet having a foamed surface on its surface, as a reflective material, because of low impact resistance of the foamed resin although the resin is generally elastic. Further, it is difficult to fabricate the reflector to have the reflective surfaces at a required angle. In this type of illuminator, a thin cold cathode fluorescent tube having a tube diameter of approximately 3 mm to 4 mm is used as a linear light source so that the overall illuminator may be thin. In addition, the fluorescent tubes are arranged with a lamp pitch of approximately 24 mm to 30 mm, and the small diameter of the cold cathode fluorescent tube is used. In consequence, the width of the corresponding reflective surfaces of the reflector must be reduced. As a result, it is required to fabricate the reflective surfaces in a high precision which makes it difficult to manufacture the reflector.

SUMMARY OF THE INVENTION

The present invention has been made to solve the above-mentioned problems.

Accordingly, it is an object of the present invention to provide a backlight illuminator having a reflector above which a plurality of parallel light sources are arranged. According to the present invention, it is possible to facilitate manufacturing the reflector by reducing the number of reflective surfaces to be formed on the reflector and also by simplifying the shape of the reflector, and also to realize illumination with a high brightness and high uniformity by effectively eliminating deterioration in brightness and uniformity on the surface to be illuminated due to the simplification of the shape of the reflector.

After extensive research and experimentation to overcome the foregoing problems, the applicant have completed the present invention based on findings as to the reflector on which a plurality of parallel linear light sources are arranged, and the shape of the reflective surfaces of the reflector.

Firstly, the description is given with regard to a reflective region having reflective surfaces formed for each light source. More specifically, the reflective region is formed in symmetry about each light source. The reflective region comprises three reflective surfaces including a reflective surface close to the light source, an intermediate reflective surface, and a reflective surface distant from the light source. The reflective surface close to the light source is formed into a flat horizontal reflective surface. The intermediate reflective surface is formed into either an angled reflective surface slanted with respect to the horizontal reflective surface or a curved reflective surface concavely curved with respect the horizontal reflective surface. The reflective surface distant from the light source is formed into an angled reflective surface slanted with respect to the horizontal reflective surface. Thus, the number of reflective surfaces for each light source can be minimized, which makes it possible to precisely form the shape of each reflective surface of the reflector. In addition, the manufacture of the reflector makes relatively easy.

The horizontal reflective surface close to the light source is positioned so as to reflect light back to a wide range of an illumination surface of the backlight illuminator. The intermediate angled reflective surface or the intermediate concavely curved reflective surface and the angled reflective surface distant from the light source are positioned so as to reflect light back to the corresponding illumination surfaces in such a manner that the reflected light overlaps the light reflected from the horizontal reflective surface. Thus, the reflective surface close to the light source, the intermediate reflective surface and the reflective surface distant from the light source are positioned relative to one another so as to intensively reflect light back to an intermediate region of neighboring two linear light sources so that excellent brightness and uniformity of brightness can be ensured on the entire illumination surface of the backlight illuminator.

The present invention has been made on the basis of the foregoing findings.

According to an aspect of the present invention, a backlight illuminator comprises a plurality of linear light sources arranged in parallel, and a reflector arranged symmetrically about each linear light source along each light source so as to reflect light from each linear light source back to a surface to be illuminated. The reflector includes a reflective region formed in symmetry on both sides of each of the light sources. The reflective region includes three reflective surfaces, namely a reflective surface close to the light source, an intermediate reflective surface, and a reflective surface distant from the light source. The reflective surface close to the light source is formed to have a horizontal surface so as to reflect light back to a region A of the surface to be illuminated. The intermediate reflective surface is formed into either an angled surface slanted with respect to the horizontal surface or a curved surface concavely curved with respect thereto so as to reflect light back to a region B of the surface to be illuminated. The reflective surface distant from the light source is formed into an angled surface slanted with respect to the horizontal reflective surface so as to reflect light back to a region C of the surface to be illuminated. The illumination ranges of the regions B and C of the surface to be illuminated are overlapped with the illumination range of the region A of the surface to be illuminated, respectively. The illumination range of the region B extends over the intermediate position of neighboring two light sources and overlaps the illumination surface on the side of the neighboring light source by approximately 0% to 20% of a distance between the light source and the intermediate position. Similarly, the illumination range of the region C extends over the intermediate position of the neighboring two light sources and overlaps the illumination surface on the side of the neighboring light source by approximately 0% to 10% of the distance between the light source and the intermediate position.

The illumination range of the region B has a narrower width than the illumination range of the region C, and the illumination range of the region B is located closer to the intermediate position of the neighboring two light sources than the illumination range of the region C.

An angle of inclination of the reflective surface distant from the light source is a right angle or an acute angle of about 70 degrees or more with respect to an adjacent reflective surface distant from the light source.

In an embodiment of the present invention, the intermediate reflective surface connected to the reflective surface distant from the light source and the reflective surface close to the light source is formed into a single reflective surface having an upward angled surface or a concavely curved surface.

This and other objects, features, and advantages of the present invention will become more apparent from reading of the following detailed description in connection with the accompanying drawings.

DETAILED DESCRIPTION OF THE PREFERRED EMBODIMENTS

A reflector of a backlight illuminator according to each of embodiments of the present invention will be described in detail below with reference to FIGS. 1 to 5.

Figure 1:
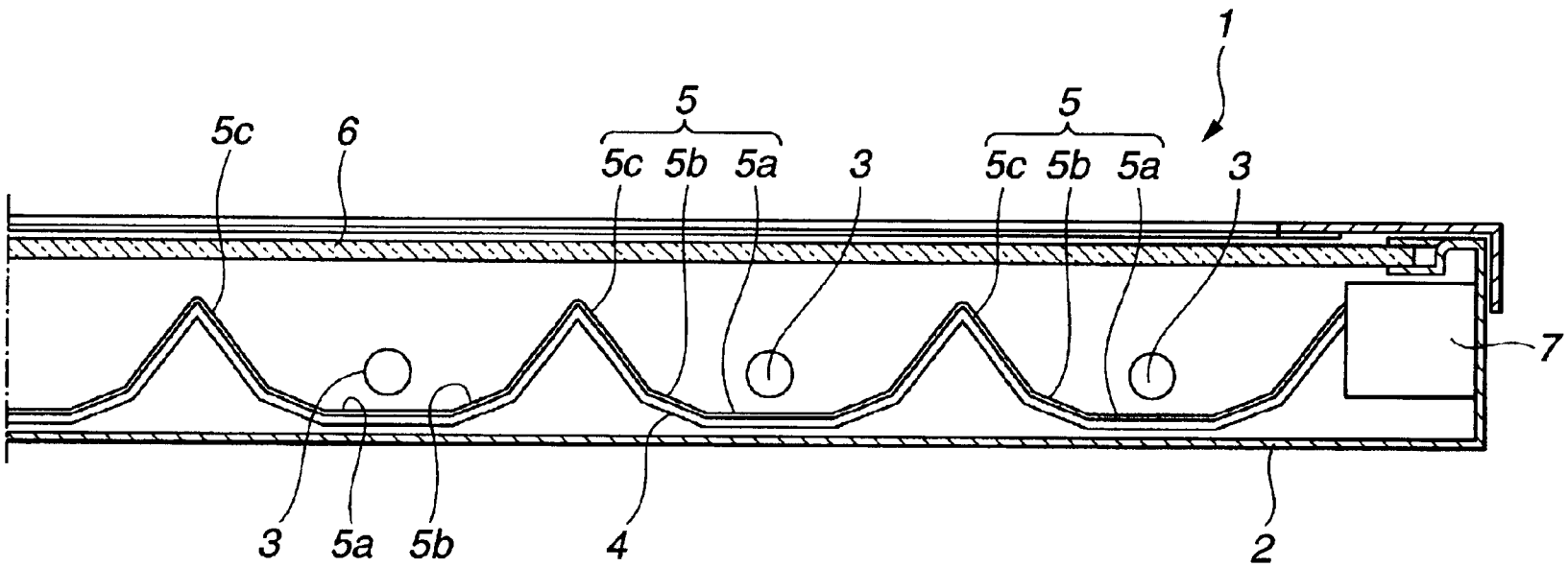
FIG. 1 is a schematic cross-sectional view of a principal part of a backlight illuminator according to an embodiment of the present invention.
Figure 2:
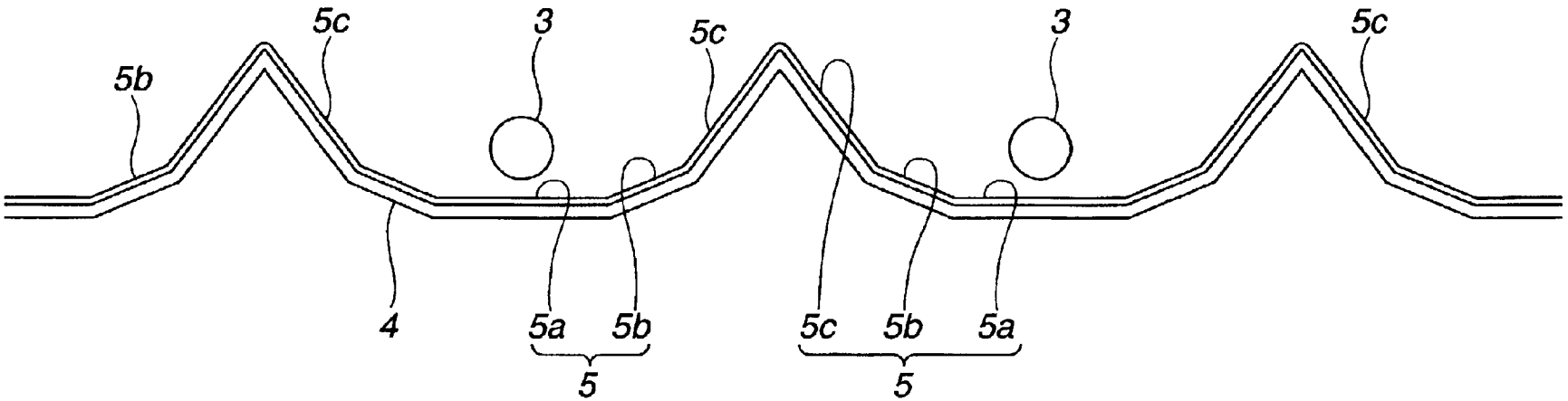
FIG. 2 is an enlarged schematic cross-sectional view of the principal part of the backlight illuminator shown in FIG. 1 showing an example of the position of reflector relative to linear light sources.

In a backlight illuminator according to one embodiment of the present invention shown in FIGS. 1 and 2, numeral 1 represents the backlight illuminator which is built in, for example, a wall-mounted type liquid crystal television set or the like. The backlight illuminator includes an inverter 7 for controlling the lighting of the backlight illuminator in order that the illuminator may act as a backlight of the liquid crystal display. The backlight illuminator 1 is housed in a box 2, and includes a plurality of linear light sources 3 arranged in parallel so as to illuminate an illumination surface 6 of the backlight illuminator 1 by light emitted from each linear light source 3, and a reflector 4 having reflective surfaces 5 formed symmetrically about each linear light source 3 along the longitudinal direction of each light source 3 so as to reflect light from each linear light source 3 back to the illumination surface 6.

In the backlight illuminator of the above embodiment, a cold cathode fluorescent tube (a cold cathode fluorescent discharge tube), for example, can be used as the linear light source 3, and a plurality of the fluorescent tubes are arranged in parallel at a regular interval. On the illumination surface 6, there is formed, for instance, a transparent or translucent resin sheet such as a translucent acrylic resin sheet containing a diffusion material and having a coarse surface, a combination of such a resin sheet and a diffuser, or the resin sheet provided with a light shield pattern for adjusting brightness near the light source.

Figure 3:
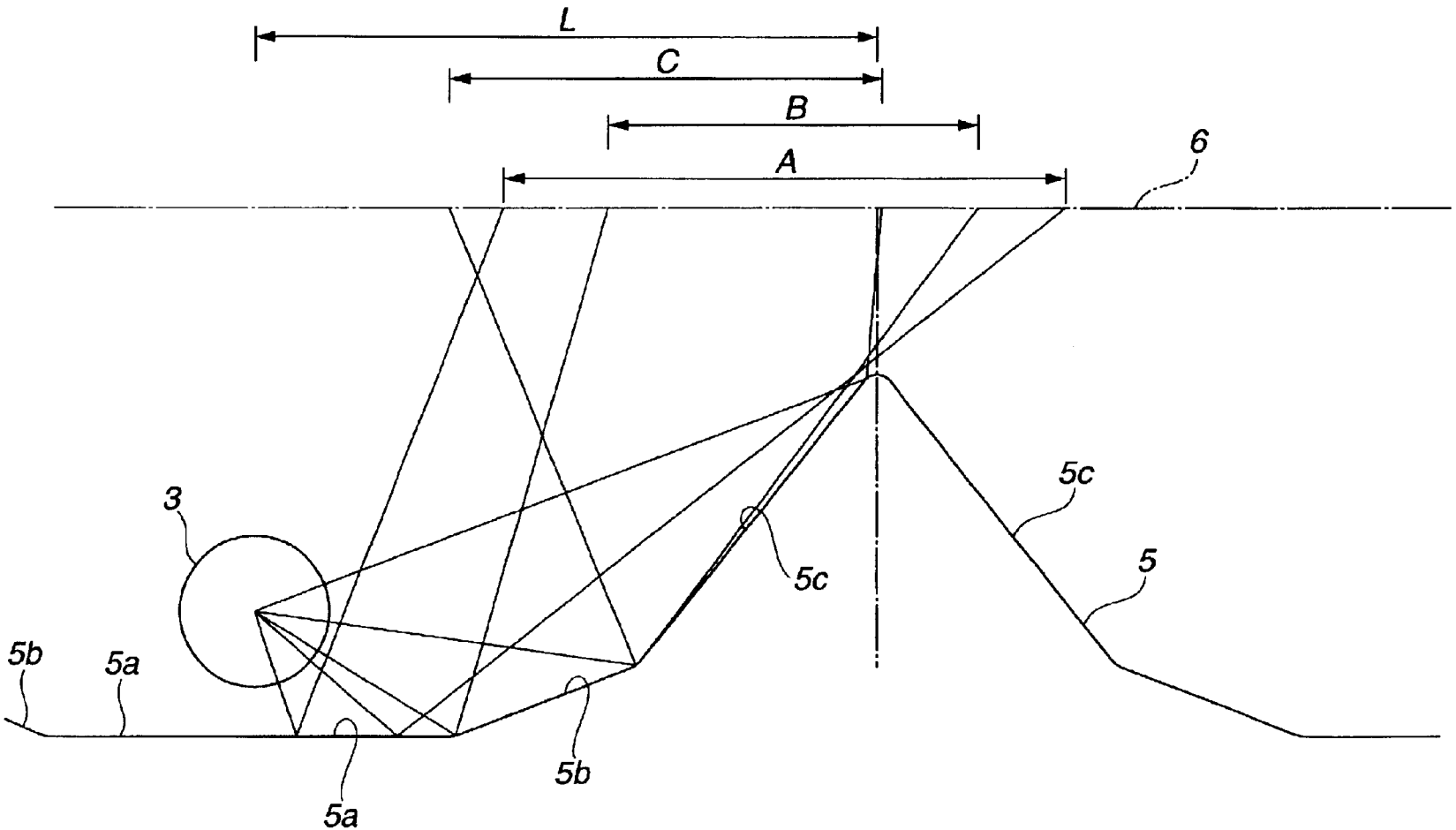
FIG. 3 is a schematic cross-sectional view showing light reflected by reflective surfaces of the reflector.
Figure 4:
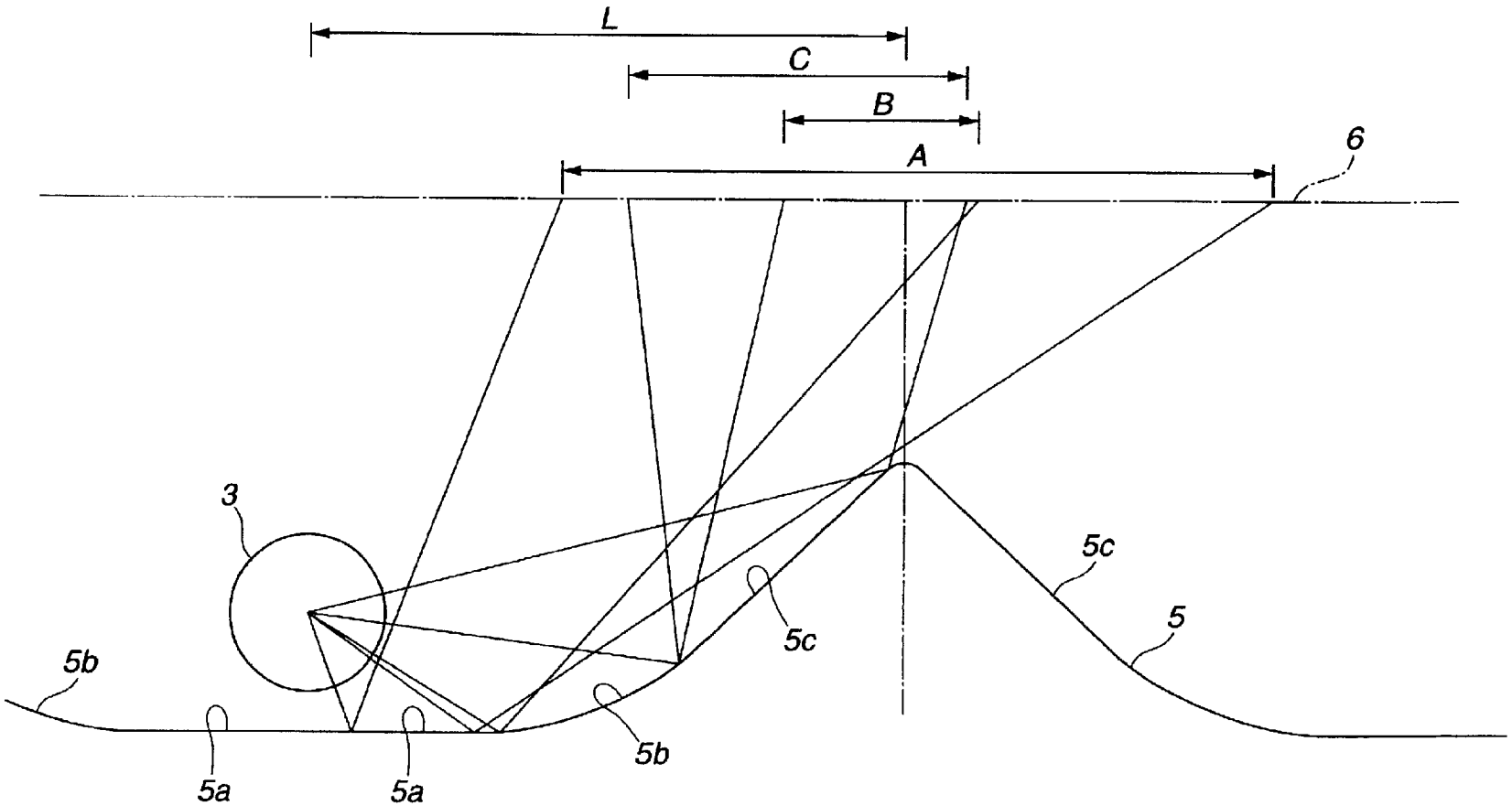
FIG. 4 is a schematic cross-sectional view showing light reflected by reflective surfaces according to another embodiment of the present invention.
Figure 5:
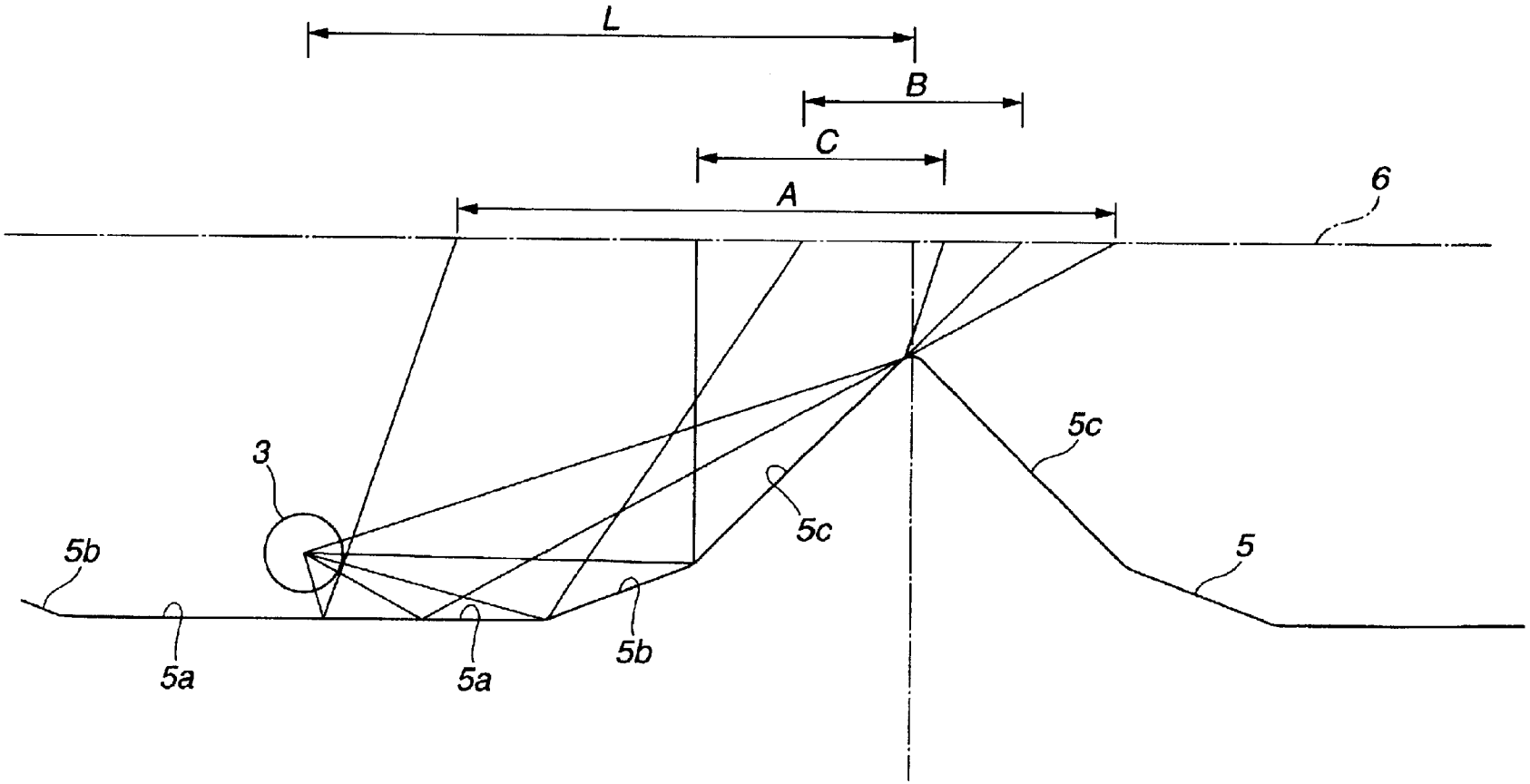
FIG. 5 is a schematic cross-sectional view showing light reflected by reflective surfaces according to still another embodiment of the present invention.

As is apparent from FIGS. 3 to 5, the reflector 4 of the present invention is divided into three reflective surfaces including a reflective surface 5*a* close to the light source 3, an intermediate reflective surface 5 and a reflective surface 5*c* distant from the light source 3. The reflective surface 5*a* is formed to have a horizontal surface so as to reflect light back to a region A of the surface 6 to be illuminated. The intermediate reflective surface 5*b* is formed to have an upward angled surface, more specifically, either an angled surface slanted with respect to the horizontal surface or a curved surface concavely curved with respect thereto so as to reflect light back to a region B of the surface 6 to be illuminated. The reflective surface 5*c* is formed to have an angled surface slanted with respect to the horizontal reflective surface in the same manner so as to reflect light back to a region C of the surface 6 to be illuminated. The reflective surfaces 5*a*, 5*b* and 5*c* are formed symmetrically about each linear light source 3.

According to the embodiment of the present invention, ranges to be illuminated with light reflected by the reflective surfaces 5*a*, 5*b* and 5*c* are set in such a manner that the respective illumination ranges of the regions B and C are overlapped with the illumination range of the region A. Moreover, the illumination range of the region B extends over the intermediate position of the neighboring two light sources and overlaps the illumination surface 6 on the side of the neighboring light source by approximately 0% to 20% of a distance L between the light source 3 and the intermediate position. Similarly, the illumination range of the region C extends over the intermediate position of the neighboring two light sources and overlaps the illumination surface 6 to be on the side of the neighboring light source by approximately 0% to 10% of the distance L between the light source 3 and the intermediate position. In this embodiment, width of the region B to be illuminated is narrower than width of the region C to be illuminated. The ranges to be illuminated with light reflected by the intermediate reflective surface 5*b* and the reflective surface 5*c* distant from the light source are set in such a manner that the illumination range of the region B is located closer to the intermediate position of the neighboring two light sources than the illumination range of the region C. According to this embodiment, the reflective surface 5 of the reflector 4 can be fabricated as simple as possible, thereby improving brightness and uniformity of brightness of the illumination surface 6, and facilitating the fabrication of the reflector 4 and shaping the reflective surface 5.

In the reflector 4 of the embodiment, the reflective surface 5 is formed of, for example, a white foamed resin sheet. The reflective surface 5 is formed of the foamed resin sheet integrally bonded to a substrate such as an aluminum sheet or a synthetic resin sheet. The substrate is bent or curved so as to form the reflective surfaces 5*a*, 5*b* and 5*c*. In this case, the reflective surface 5 is formed in such a manner that an angle of inclination of the reflective surface 5*c* distant from the light source is a right angle or an acute angle of about 70 degrees or more with respect to the neighboring reflective surface distant from the light source. The intermediate reflective surface 5*b* is connected to the reflective surface 5*c* distant from the light source and the reflective surface 5*a* close to the light source 3. Thus, the reflective surfaces 5*b* and 5*c* are formed to have the reflective surface having the upwardly angled surface or the concavely curved surface having a required angle.

Examples of the reflector 4 are illustrated in FIGS. 3 to 5. The surface 6 is initially illuminated by direct light emitted from the linear light source 3, and the brightness of the illumination decreases in accordance with remoteness from the linear light source 3. The reflective surfaces 5*a*, 5*b* and 5*c* of the reflector 4 reflect light back to the corresponding illumination ranges in order to compensate for the decrease in the brightness on the surface 6 to be illuminated.

In an embodiment shown in FIG. 3, the reflective surface 5*a* immediately below the light source 3 is horizontal having width of, for example, a few millimeters. While, the peak position of the reflective surface 5*c* distant from the light source 3 is located above the light source 3. For instance, the reflective surface 5*c* is protruded from the horizontal surface 5*a* by approximately 7 mm to 9 mm in height. The reflective surface 5*c* forms an angle of 74 degrees with respect to the adjacent reflective surface 5*b* distant from the light source. The intermediate reflective surface 5*b* between the reflective surfaces 5*a* and 5*c* is a few millimeters in width and slanted at an angle of, for example, about 20 degrees with respect to the horizontal surface 5*a*.

This reflector enables the reflective surface 5*a* close to the light source to reflect light back to the wide illumination range of the region A of the surface 6. The region A extends from the position above the light source 3 to the illumination surface 6 on the side of the neighboring light source by a few millimeters in width. In addition, the reflector enables the reflective surface 5*c* distant from the light source to reflect light back to the region C of the illumination surface 6. The region C is located above the reflective surface 5*c* and slightly close to the light source 3, and extends from the position close to the light source to the intermediate position of the neighboring two light sources so as to overlap the region A to be illuminated. Further, the reflector enables the intermediate reflective surface 5*b* to reflect light back to the region B of the illumination surface 6. The region B is narrower than the region C in width, and the region B extends to the intermediate position of the neighboring two light sources lying within the illumination range of the region A and overlapping the region C. The regions B and C extend over the intermediate position of the neighboring two light sources and overlap the illumination surface 6 on the side of the neighboring light source. The region B overlaps the illumination surface 6 on the side of the neighboring light source in the extent of approximately 17% of the distance L between the light source 3 and the intermediate position of the neighboring two light sources. In this embodiment, the distance L is approximately 1.5 cm. The region C overlaps the illumination surface 6 on the side of the neighboring light source in the extent of approximately 1% of the distance L. Thus, both the regions B and C are overlapped with the reflected light on the region A illuminating the intermediate position of the neighboring two light sources 3. As a result, the illumination surface 6 including the intermediate position of the neighboring two light sources can be illuminated with a high brightness and high uniformity.

In another embodiment shown in FIG. 4, the region A illuminated by the horizontal reflective surface 5*a* overlaps the illumination surface 6 on the side of the neighboring light source to a wider extent as compared with the region A of the embodiment shown in FIG. 3. Further, the peak position of the reflective surface 5*c* distant from the light source is located at the slightly lower position as compared with the embodiment shown in FIG. 3, and the reflective surface 5*c* forms an angle of 90 degrees with respect to the neighboring reflective surface distant from the light source. Thus, the region C to which the reflective surface 5*c* reflects light back ranges from near the light source 3 to near the intermediate position of the light sources. The intermediate reflective surface 5*b* has the concavely curved surface, and the region B to be illuminated by the reflective surface 5*b* has a narrower width and is thus located near the intermediate position of the light sources. The width of reflected light beyond the intermediate position of the neighboring two light sources in the region B is approximately 12% of the distance L. The width of reflected light beyond the intermediate position between the neighboring two light sources in the region C is approximately 10% of the distance L. The embodiment shown in FIG. 4 ensures illumination with a high brightness and high uniformity of brightness on the surface 6 to be illuminated including the intermediate position of the neighboring two light sources similar to the embodiment shown in FIG. 3.

In still another embodiment shown in FIG. 5, there is provided an example of the reflector 4 suitable for the illuminator of the present invention similar to the embodiments shown in FIGS. 3 and 4. The reflector is provided with a light shield pattern formed on the resin sheet by printing a translucent dot pattern in order to adjust brightness near the light source. In this embodiment, the distance L between the light source 3 and the intermediate position of the neighboring two light sources is approximately 2.5 cm. The reflector 4 is greater in width, namely, the horizontal reflective surface 5*a* close to the light source is slightly greater in width as compared with the embodiments shown in FIGS. 3 and 4. The peak position of the reflective surface 5*c* distant from the light source is located at the substantially same position as that of the embodiments shown in FIGS. 3 and 4, and the reflective surface 5*c* forms an angle of approximately 90 degrees with respect to the adjacent reflective surface distant from the light source. Thus, the region C to which the reflective surface 5*c* reflects light back ranges from the position over the reflective surface 5*c* to near the intermediate position of the light sources. The intermediate reflective surface 5*b* is slightly narrower in width as compared with the embodiments shown in FIGS. 3 and 4, and thus the region B to be illuminated corresponding to the reflective surface 5*b* is located near the intermediate position between the light sources. The width of reflected light beyond the intermediate position of the neighboring light sources in the region B is approximately 18% of the distance L. The width of reflected light beyond the intermediate position of the neighboring light sources in the region C is approximately 5% of the distance L. The reflector provided with the light shield pattern ensures illumination with a high brightness and high uniformity of brightness on the surface 6 to be illuminated including the intermediate position of the neighboring light sources similar to the embodiments shown in FIGS. 3 and 4.

Since the structural components and functions of the embodiments shown in FIGS. 4 and 5 are basically the same as those of the embodiment shown in FIG. 3, the same parts in the drawings are designated by the same reference numerals and the description thereof is omitted.

According to the embodiments shown in FIGS. 3–5, the width of reflected light beyond the intermediate position of the light sources in the region B illuminated by the intermediate reflective surface 5*b* is approximately 0% to 20% of the distance L, and the width of reflected light beyond the intermediate position of the light sources in the region C illuminated by the reflective surface 5*c* distant from the light source is approximately 0% to 10% of the distance L. In the embodiment shown in FIG. 3, the width thereof in the region B is approximately 17% of the distance L, and the width thereof in the region C is approximately 1% of the distance L. In the embodiment shown in FIG. 4, the width thereof in the region B is approximately 12% of the distance L, and the width thereof in the region C is approximately 10% of the distance L. In the embodiment shown in FIG. 5, the width thereof in the region B is approximately 18% of the distance L, and the width thereof in the region C is approximately 5% of the distance L. When the width of reflected light beyond the intermediate position in either the region B or C to be illuminated is less than 0% and thus the reflected light does not reach the intermediate position, a linear dark portion may appear at the intermediate position and results in the uniformity of brightness. When the width of reflected light beyond the intermediate position in the region B to be illuminated is more than 20% or the width of reflected light beyond the intermediate position in the region C to be illuminated is more than 10%, the uniformity of brightness on the surface to be illuminated is significantly damaged. Therefore, the width of reflected light beyond the intermediate position within the range described above embodiments permits the liquid crystal display to illuminate in a uniform brightness if it is used as a backlight of the liquid crystal display, even if there are some variations in extent of overlap of the regions B and C on the region A.

According to the embodiments of the present invention, the angle of the reflective surface 5*c* distant from the light source is the substantially right angle or the acute angle of about 70 degrees or more with respect to the neighboring reflective surface distant from the light source, namely, an angle of 70 to 90 degrees inclusive. The angle of the reflective surface 5*c* is 74 degrees in the embodiment shown in FIG. 3, and 90 degrees in the embodiments shown in FIGS. 4 and 5. If the angle of the reflective surface 5*c* lies within this range, the region B to which the reflective surface 5*c* reflects light back, can be located at the position just above the reflective surface 5*c*. The reflective surface 5*c* directs reflected light including direct light from the light source 3 and light reflected by the reflective surface 5*a* intensively to a dark portion of the illumination surface 6, thereby ensuring the highest possible uniformity of brightness all over the illumination surface 6. The horizontal reflective surface 5*a* close to the light source 3 and the reflective surface 5*c* distant from the light source facilitate to form the intermediate reflective surface 5*b*, and reflected light from the reflective surface 5*b* allows an improvement in the uniformity of brightness. If the angle exceeds 90 degrees, the region C to be illuminated by the reflective surface 5*c* distant from the light source extends in large extent beyond the intermediate position of the light sources, and the width of reflected light beyond the intermediate position exceeds 0% to 10% of the distance L. In this instance, unnecessary brighter portion appears on the side of the neighboring light source and results in the uniformity of brightness. If the angle is less than 70 degrees, the region C to be illuminated by the reflective surface 5*c* distant from the light source extends in the return direction on the light source side. In consequence, the width of reflected light beyond the intermediate position becomes minus. Thus, the width of reflected light beyond the intermediate position cannot lie within the above range, and unnecessary brighter portion appears and the uniformity of brightness is damaged in the same way as the above instance.

As described in detail by referring to the embodiments of the present invention, the reflective surface 5 on one side of each linear light source 3 is divided into three reflective surfaces including the reflective surface 5*a* close to the light source 3, the intermediate reflective surface 5*b*, and the reflective surface 5*c* distant from the light source 3. The reflective surface 5*a* close to the light source 3 is formed to have the horizontal surface, the intermediate reflective surface 5*b* is formed to have either the angled surface or the concavely curved surface, and the reflective surface 5*c* distant from the light source 3 is formed to have the angled surface. Thus, the reflective surfaces of the reflector 4 is significantly reduced in number. Nevertheless, each of the reflective surfaces 5*a*, 5*b* and 5*c* have an effective width of at least approximately a few millimeters, and the fabrication of the reflective surfaces and the manufacture of the reflector 4 can be simplified and facilitated, even if the cold cathode fluorescent tube is used as a light source.

Further, the reflective surface 5*a* close to the light source has the horizontal surface so as to reflect light back to the wide range of the region A of the surface 6 to be illuminated, while the intermediate reflective surface 5*b* and the reflective surface 5*c* distant from the light source reflect light back to the regions B and C in such a manner that the reflected light overlaps the region A and is directed to the intermediate position of the light sources so as to illuminate the surface 6 with a high brightness and high uniformity of brightness.

Although the specific embodiments of the present invention have been explained with reference to the accompanying drawings, it is to be understood that the overall structure of the backlight illuminator, the light source and the reflector thereof, a specific material, shape and configuration of the reflective surface thereof, the relationship among them, the use of the foamed resin sheet without using the substrate, the use of any other highly reflective material as a reflector, the use of the backlight illuminator in applications such as display device or illumination display boards using the cold cathode fluorescent tube as a light source, may be optionally adopted or changed so long as they do not depart from the spirit of the present invention.

Obviously, many modifications and variations of the present invention are possible in the light of the above teachings. It is therefore to be understood that within the scope of the appended claims, the invention may be practiced otherwise than as specifically described.

What is claimed is:

1. A backlight illuminator comprising:

a plurality of linear light sources arranged in parallel;

a surface to be illuminated fixedly positioned above said linear light sources; and a reflector arranged symmetrically about each linear light source along each light source so as to reflect light from each linear light source back to the surface to be illuminated, said reflector including a reflective region formed in symmetry on both sides of each of the light sources, said reflective region consisting of a first reflective surface close to the light source, a second reflective surface, an a third reflective surface distant from the light source, said first reflective surface close to the light source being formed to have a horizontal surface so as to reflect light back to a first region of the surface to be illuminated, said second reflective surface being formed into either an angled surface slanted with respect to the horizontal surface or curved surface concavely curved with respect thereto so as to reflect light back to a second region of the surface to be illuminated, said third reflective surface distant from the light source being formed into an angled surface slanted with respect to the horizontal reflective surface so as to reflect light back to a third region of the surface to be illuminated, illumination ranges of the second and third regions of the surface to be illuminated being overlapped with an illumination range of the first region of the surface to be illuminated, said illumination range of the second region extending over an intermediate position between each two neighboring light sources to overlap an illumination surface corresponding to each neighboring light source and defined between two intermediate positions by 0% to 20% of a distance between the light source and the intermediate position, and said illumination range of the third region extending over the intermediate position of the neighboring light source to overlap the illumination surface of the neighboring light source by 0% to 10% of the distance between the light source and the intermediate position.

2. The backlight illuminator as defined in claim 1, wherein the illumination range of the second region has a narrower width than the illumination range of the third region, and the illumination range of second region is located closer to the intermediate position of the neighboring light sources than the illumination range of the third region.

3. The backlight illuminator as defined in claim 1, wherein an angle of inclination of said third reflective surface distant from the light source is a right angle or an acute angle of approximately 70 degrees or more with respect to an adjacent reflective surface distant from the light source.

4. The backlight illuminator as defined in claim 3, wherein said second reflective surface connected to said third reflective surface distant from the light source and the first reflective surface close to the light source is formed into a single reflective surface having an upward angled surface or the concavely curved surface.

5. The backlight illuminator as defined in claim 2, wherein an angle of inclination of said third reflective surface distant from the light source is a right angle or an acute angle of approximately 70 degrees or more with respect to an adjacent reflective surface distant from the light source.

* * * * *